US006986225B2

(12) United States Patent
Gjersoe et al.

(10) Patent No.: US 6,986,225 B2
(45) Date of Patent: Jan. 17, 2006

(54) PART OF FACADE, PARTITION WALL OR EQUAL CONSTRUCTION WHICH CAN BE USED ON BOTH SIDES, AND MOUNTINGS FOR THIS FACADE

(76) Inventors: Thomas Gjersoe, deceased, late of Rykkin (NO); by Finn Alexander Gjersoe, legal representative, Einebaerstien 9, N-1349 Rykkin (NO)

( * ) Notice: Subject to any disclaimer, the term of this patent is extended or adjusted under 35 U.S.C. 154(b) by 0 days.

(21) Appl. No.: 10/377,307

(22) Filed: Feb. 28, 2003

(65) Prior Publication Data

US 2003/0217512 A1 Nov. 27, 2003

Related U.S. Application Data

(63) Continuation-in-part of application No. 09/762,393, filed as application No. PCT/NO99/00260 on Aug. 19, 1999, now abandoned.

(30) Foreign Application Priority Data

Aug. 19, 1998 (NO) ..... 983795

(51) Int. Cl.
*E05D 7/08* (2006.01)

(52) U.S. Cl. ..... 49/388; 49/392

(58) Field of Classification Search ..... 49/388, 49/390, 391, 392, 393, 354
See application file for complete search history.

(56) References Cited

U.S. PATENT DOCUMENTS

| | | | | | |
|---|---|---|---|---|---|
| 359,283 | A | * | 3/1887 | Pihlstrom | 49/393 |
| 371,245 | A | * | 10/1887 | Barber | 49/193 |
| 2,750,015 | A | * | 6/1956 | Hauck | 49/392 |
| 2,811,754 | A | | 11/1957 | Toth | 49/390 |
| 4,080,758 | A | | 3/1978 | Hubbard | 49/390 |
| 4,142,272 | A | | 3/1979 | Oogami et al. | 16/130 |
| 4,209,946 | A | * | 7/1980 | Akai | 49/390 |
| 4,307,542 | A | | 12/1981 | Lense | 49/318 |
| 4,365,620 | A | | 12/1982 | Bliamptis | 126/429 |
| 4,428,154 | A | | 1/1984 | Rinehart | 49/390 |

FOREIGN PATENT DOCUMENTS

| | | |
|---|---|---|
| NO | 75159 | 5/1949 |
| NO | 94708 | 8/1959 |
| NO | 109045 | 5/1966 |
| NO | 146293 | 5/1982 |
| WO | WO 00/11299 | 3/2000 |

* cited by examiner

*Primary Examiner*—Jerry Redman
(74) *Attorney, Agent, or Firm*—Sheridan Ross P.C.

(57) ABSTRACT

An apparatus, such as a window in a frame which is mounted in a casing and that can be pivoted 180° within the casing for use on both faces. A pair of concealed hinges mounted, between the casing and the frame, provide pivots about which the frame is rotated. Further, a connector is mounted on opposing faces of the frame. An opening and closing device can be alternately connected and disconnected between the casing and opposing connecters. When disconnected, the frame is rotatable. Once rotated, the opening and closing device is reconnected to the connector on the opposite face of the window. Deformable sealing elements are mounted around the periphery of the frame and on either side of the concealed hinges to provide an air tight seal when the frame is closed.

20 Claims, 12 Drawing Sheets

Fig. 4
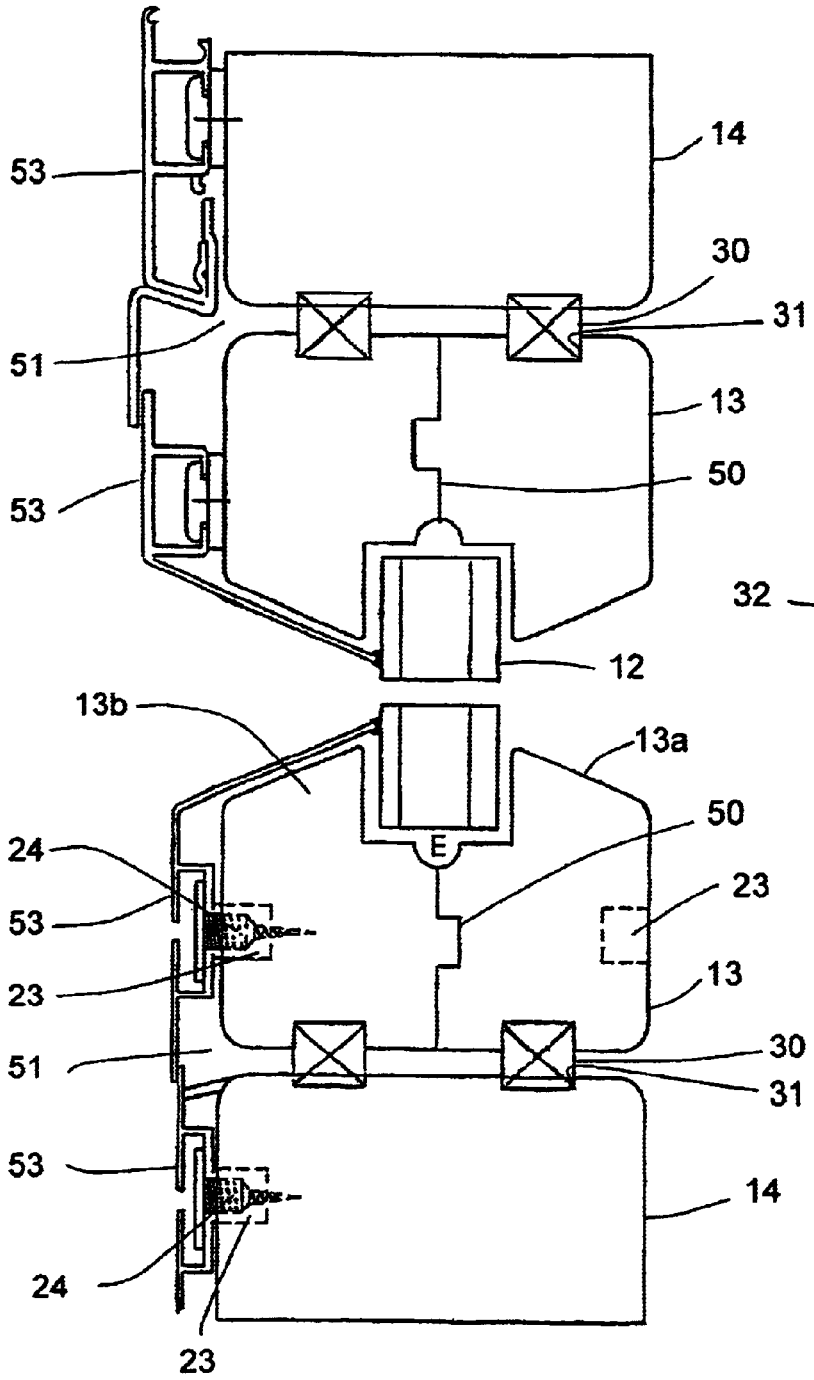
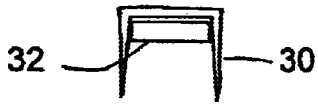
Fig. 5

Fig. 10a
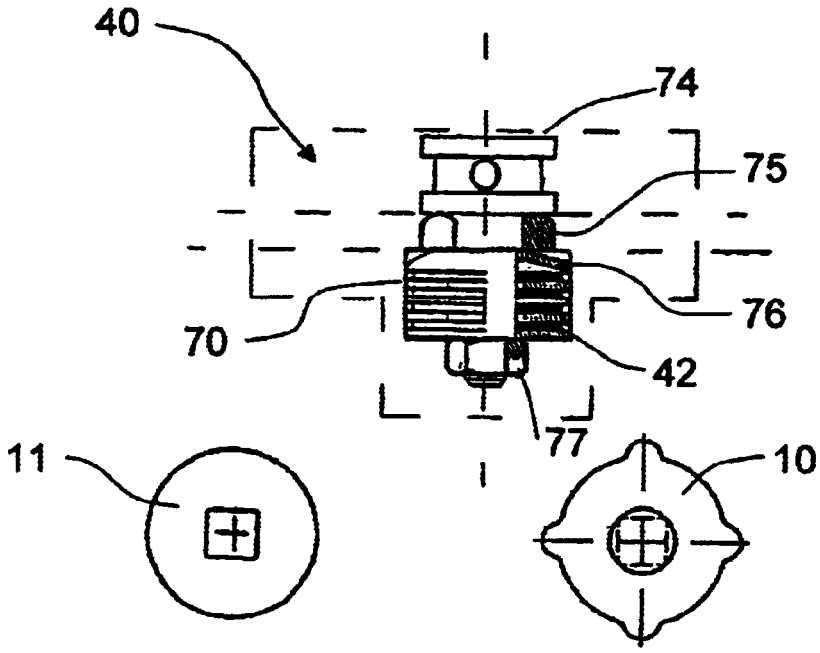
Fig. 10c
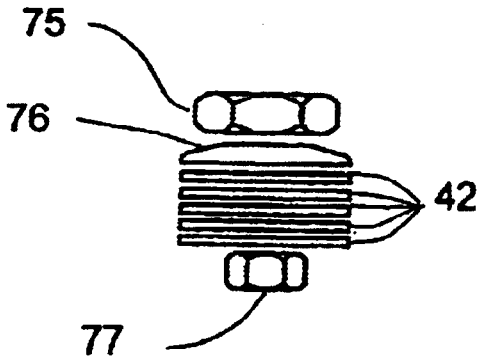
Fig. 10b
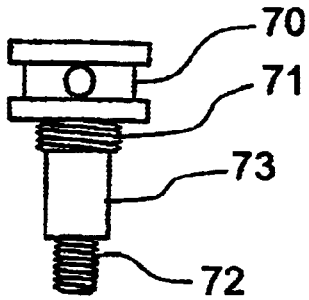
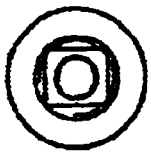
Fig. 10d

Fig. 13e
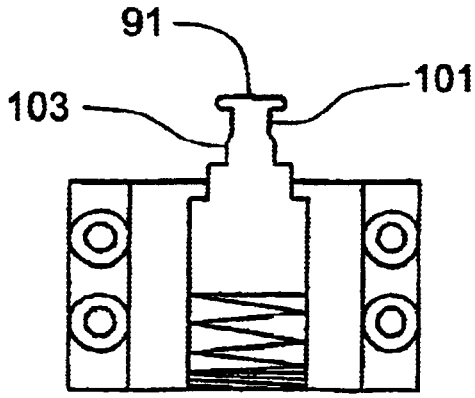
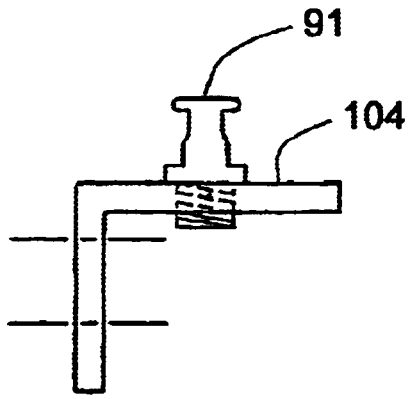
Fig. 13g
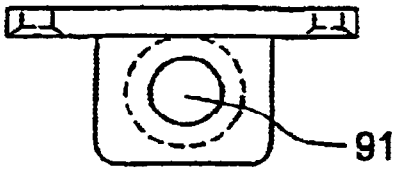
Fig. 13f

PART OF FACADE, PARTITION WALL OR EQUAL CONSTRUCTION WHICH CAN BE USED ON BOTH SIDES, AND MOUNTINGS FOR THIS FACADE

CROSS REFERENCE TO RELATED APPLICATIONS

This application is a continuation in part of U.S. patent application Ser. No. 09/762,393, now abandoned, filed on Mar. 20, 2001 which is a 35 U.S.C. 371 National stage of PCT/NO99/00260 dated Aug. 19, 1999, the entirety of each of the related applications being incorporated herein by reference.

FIELD OF THE INVENTION

The present invention relates to parts of facades, partitions or the like which can be used on both sides including those having properties on each rendering it desirable to be able to turn the part in its support and secure it from undesired rotation. The present invention also relates to hardware for such swiveling or pivoting such parts including mountings, optionally fit with friction elements, and also fittings which facilitate the swiveling or pivoting of the parts.

BACKGROUND OF THE INVENTION

A great number or more or less complex devices are known in the art for at least partly turning windows so as to make the outer surface accessible for maintenance from the inside of buildings. The aim has been to turn the window as close to 180° as possible to allow easy access for maintenance. However, in the cases where the pivoting has taken place through virtually 180°, the general plane through the window has been displaced so as to lie outside the general facade plane, whilst windows using the other conventional pivot means can only be turned approximately 180°.

Today's building technology uses, not least when it comes to cladding glass, highly specialized windows of double or multilayer type and having a sophisticated system of coatings sometimes with highly selective reflection and transmission properties. The object of these energy-efficient windows is to maximize or optimize both the transmission and reflection of heat and light. These are contrary purposes.

SUMMARY OF THE INVENTION in one embodiment, the apparatus of the present invention enables a supported part to rotation through 180° about opposing pivots, placed either vertically or horizontally along an axis which passes through the center of the part. A typical supported part is a frame such as that for a window, door or partition. Connectors attached to opposing sides or faces of such a frame permit the frame to be releasably connected to a structure or casing in which it is mounted. Corresponding connectors are provided on either face of the frame and thus facilitate use of either face of the frame for purposes including maintenance to thus garner full advantage of a frame having different characteristics on each face.

The invention is described herein in the context of a window supported in a frame and mounted within a casing, although one skilled in the art would appreciate that the invention is readily applicable to other apparatus such as doors, facades, partitions and the like.

Windows may be manufactured having different transmission and absorption properties on opposing faces for us in different climatic conditions and thus employing the present invention, the window can be easily pivoted to take advantage of those characteristics without having to remove the window from the casing.

In a broad aspect of the invention, apparatus is supported in a frame and horizontally swiveled or vertically pivoted within a casing for use on either face and comprises: a pivot located between the casing and the frame at opposing horizontal or vertical positions along an axis which passes through the center of the frame for rotating the frame thereabout from 0–180 degrees; deformable sealing elements positioned about a periphery of the apparatus attached to one of either the casing or the frame for sealing between the casing and the frame; and connectors located on opposing faces of the frame to permit the frame to be connected to the casing on one face of the frame or alternately to the opposing face of the frame. The connectors further enable an opening and closing device to be alternately attached to either face of the frame and thus permit the window to be opened and closed and to be actuated to rotate fully about the pivots and to be again locked into position having either face of the window exposed to the exterior of the structure.

Preferably, the deformable sealing elements are U-shaped strips which are attached to either the casing or to the frame. The U-shaped strips are sized slightly larger than the gap between the casing and the frame, causing the sealing elements to deform and create an airtight seal therebetween. More preferably, a U-shaped strip is mounted on either side of the pivot so that when the window is rotated about the pivot, a sealing element will be positioned between the weather exposed face of the window and the pivot.

Preferably, the pivot is housed within a concealed hinge which is mounted between the casing and the frame. Depending upon the embodiment of the hinge, the bulkier portions are best recessed in the casing between the deformable sealing elements.

More preferably, the concealed hinge further houses a friction element which acts to increase the friction, acting upon the pivot to restrain the window from free rotation about the pivot. This is of particular concern if the window is bumped or is subject to gusts of wind or pressure changes within the structure and the like.

BRIEF DESCRIPTION OF THE DRAWINGS

FIG. 4 is a cross-sectional view according to FIG. 1;

FIG. 5 is a cross-sectional view of a U-shaped strip illustrating a nailing strip used for attaching the U-shaped strip to either the casing or the frame;

FIG. 8*a* is a side view illustrating opposing portions of the concealed hinge prior to engagement;

FIG. 8*b* is a side view illustrating opposing portions of the concealed hinge in an engaged position; and FIG. 8*c* is a plan view of a first mounting plate of one of the opposing portions of the concealed hinge;

FIG. 9*a* is a side view illustrating friction elements and a disc spring in a housing positioned between the bolt plate and the first mounting plate;

FIG. 9*b* is a plan view of the friction element housing;

FIG. 9*c* is an end view according to FIG. 9*b;*

FIG. 9*d* is a bottom view according to FIG. 9*b;*

FIG. 9*e* is a side view according to FIG. 9*b;*

FIG. 9*f* is a plan view of a first embodiment of a friction disc; and

FIGS. 10*a* to 10*c* illustrate an alternate embodiment of a pivot bolt and attached friction elements, more particularly;

FIG. 10*a* is a side sectional view of a pivot bolt with attached friction elements, an adjustment nut and a locking nut;

FIG. 10*b* is a side sectional view illustrating the pivot bolt according to FIG. 10*a*;

FIG. 10*c* is a side sectional view of the friction elements, adjustment nut and locking nut according to FIG. 10*a*; and FIG. 10*d* is a bottom view according to FIG. 10*b*;

FIG. 11*a* is a side sectional view illustrating a pivot bolt and friction element having a lever arm for adjusting the friction element;

FIG. 11*b* is a side view according to FIG. 11*a*; and

FIG. 11*c* is a plan view according to FIG. 11*a;*

FIG. 12*a* is a sectional side view illustrating the pivot bolt and friction elements according to FIG. 10*a* incorporated into a concealed hinge;

FIG. 12*b* is a side view according to FIG. 12*a*; and

FIG. 12*c* is a plan view according to FIG. 12*a;*

FIGS. 13*a* to 13*g* illustrate one possible embodiment of a closing device, more particularly;

FIG. 13*a* is a side view of a bracket and actuation arm of one embodiment of an opening and closing device;

FIG. 13*b* is a plan view of the actuation arm illustrating a sliding track formed thereon;

FIG. 13*c* is a side view of a block and guide pin attached to a casing and supporting the actuation arm according to FIG. 13*a* for connection to a connector on the window frame;

FIG. 13*d* is a front view of one embodiment of the connector located on the frame;

FIG. 13*e* is a side view illustrating one embodiment of a guide pin spring loaded in the block;

FIG. 13*f* is a plan view according to FIG. 13*e*; and

FIG. 13*g* is an alternate embodiment of a guide pin threaded for engagement in an L-shaped block.

DETAILED DESCRIPTION OF THE PREFERRED EMBODIMENT

Figure 1:
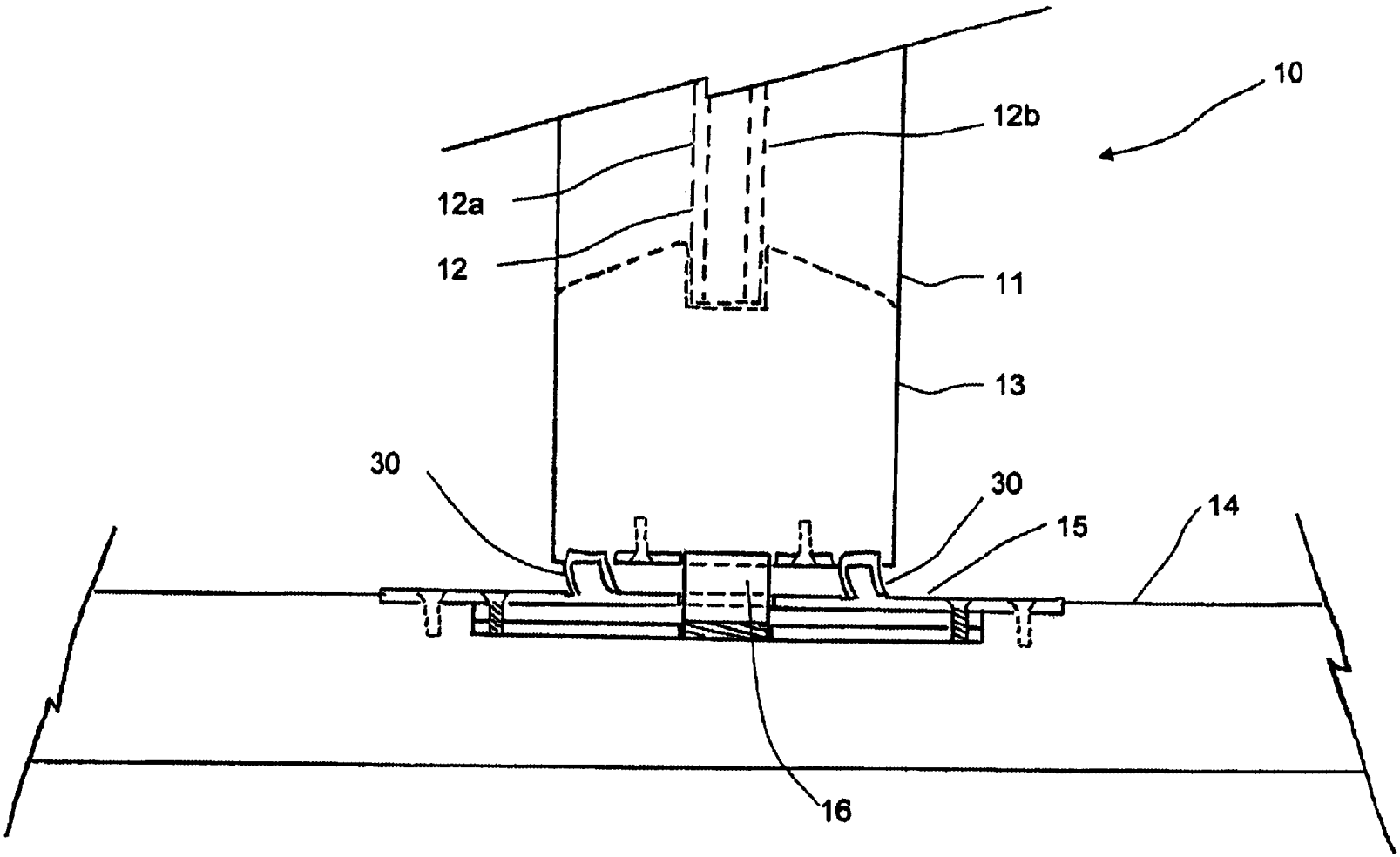
FIG. 1 is a partial cutaway view of an apparatus according to the present invention wherein the apparatus is a window mounted in a casing, the window shown swiveled 90 degrees within the casing.
Figure 2:
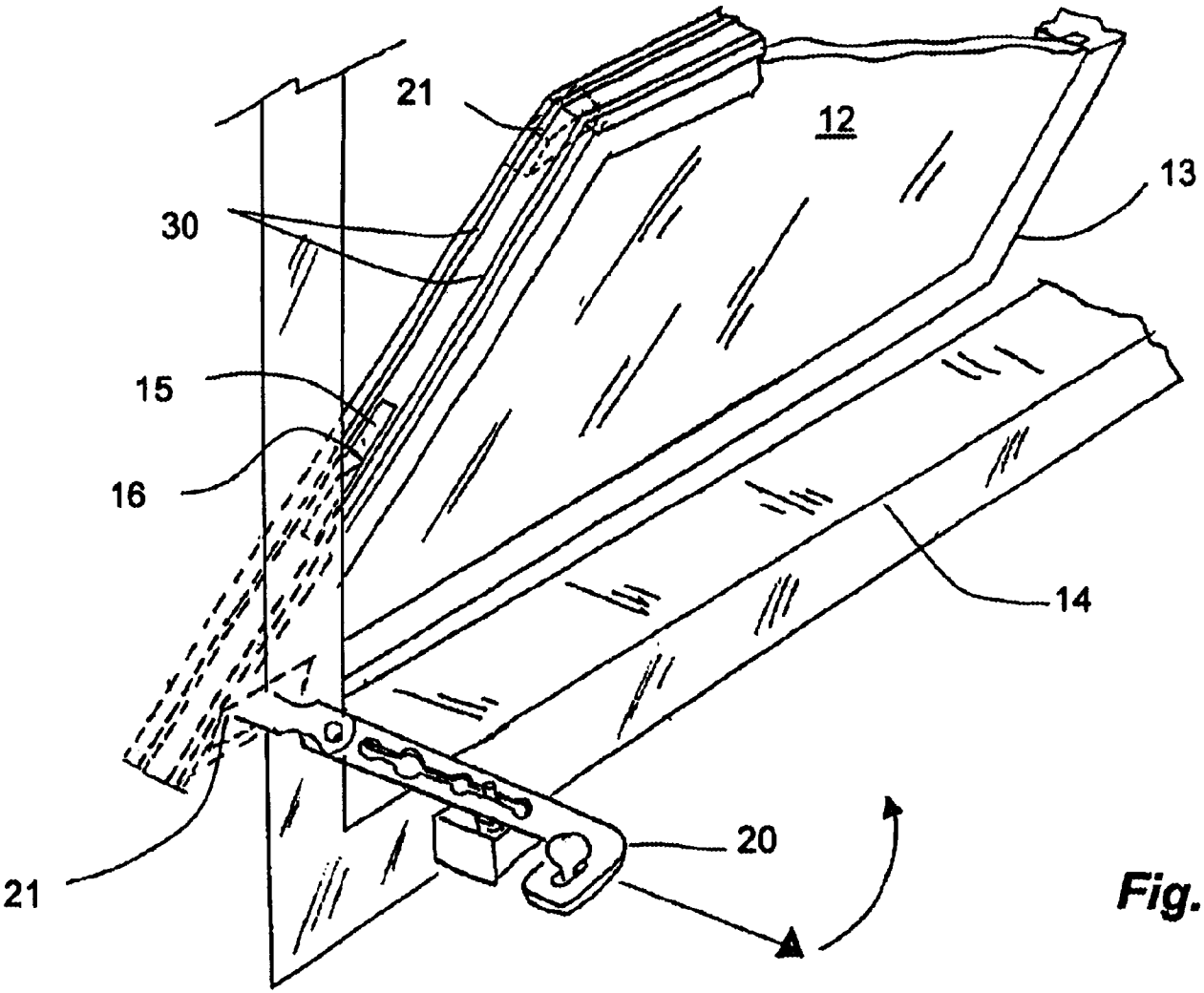
FIG. 2 is an isometric view of the window according to FIG. 1 shown in an open position.
Figure 3:
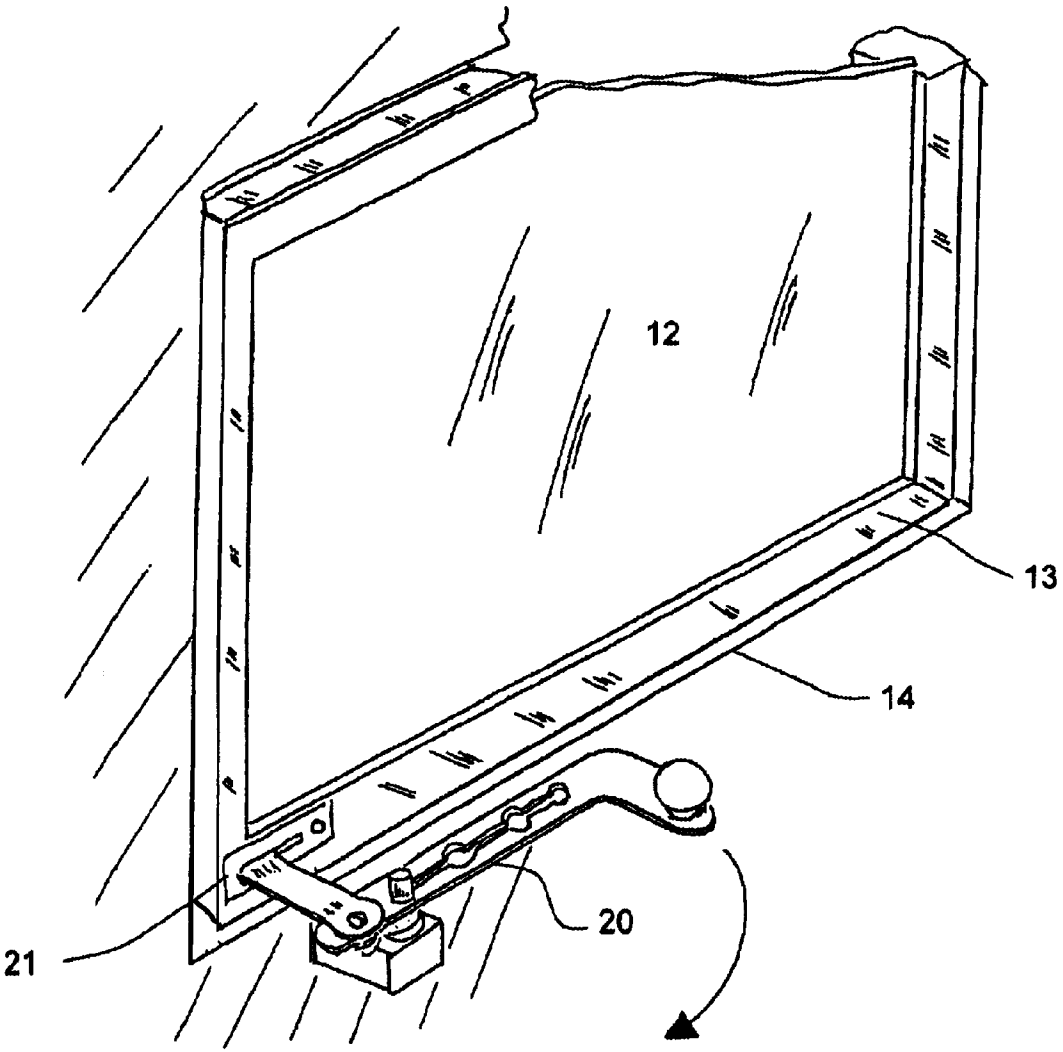
FIG. 3 is an isometric view of the window according to FIG. 2 shown in an closed position and illustrating one embodiment of an opening and closing device.

Having reference to FIGS. 1–3, apparatus 10 of the present invention is shown, It will be appreciated that the apparatus 10 is described herein in the context of a window 11 having a glazed portion 12 fit within a frame 13 and mounted in a casing 14. The invention, as it is described, can be equally applied to other apparatus 10 such as doors, facades, partitions or walls that can be rotated within a casing 14 or other suitable opening in a structure, for use on either face. The term frame 13 herein is to be interpreted as any structure which is rotatably supported in the casing 14.

The frame 13 is mounted on vertical or horizontal opposing concealed hinges 15. Each hinge 15 comprises a pivot 16 located between the frame 13 and the casing 14 and are located and extend along an axis which passes through the center of the frame 13 as to permit the window 11 to be pivoted or swiveled through 180° while being retained within the casing 14 and without interference therewith. Thus one can take advantage of both faces of the glazed portion 12 of the window 11, particularly if opposing faces 12*a*, 12*b* have different transmission or absorption properties and to permit cleaning and maintaining of both faces of the window 11 with convenient access from one face only.

An opening and closing device 20 is connected between the frame 13 and the casing 14. The device 20 is employed to both lock the frame 13 into a closed position and to actuate the window 11 to pivot about the hinge 15. The window 11 can be pivoted to an open position at any angle between 0° and 180°. Further, the opening and closing device 20 can be disconnected from a connector 21*a* on one face of the frame 13 and reconnected to a connector 21*b* on an opposing face of the frame 13 to permit locking the window 11 into a closed position following 180° rotation. Due to the connectors 21*a*, 21*b*, alternate openers can be applied and need not have a very extensive opening stroke. Conventional scissor-type openers or other openers could be employed.

The frame 13 and casing 14 are about their periphery and interface, with deformable sealing elements 30 positioned between the frame 13 and the casing 14 and affixed to one of either the frame 13 or the casing 14 to create an air tight seal when the window 11 is in the closed position. Preferably, the deformable sealing elements 30 are U-shaped strips 30 positioned on either face of the concealed hinge 15 so that when the window 11 is rotated, one of the U-shaped strips 30 positioned between a weather-exposed face of the window 11 and the hinges 15.

As shown in FIGS. 4–7, the U-shaped strips 30 are preferably fastened to either the casing 14 or to the frame 13 in pre-formed grooves 31 by means of stripping 32 which is tacked or stapled in place.

With reference to FIG. 4 and in a preferred embodiment of the invention, the frame 13 is divided into two parts 13*a* and 13*b*, preferably placed against one another with tongues and grooves 50 to ensure lateral stability and fastened to one another by means of screws (not shown).

The apparatus 10, is intended to be turned about an axis perpendicular to the figure's paper plane and which lies in a plane in the centre of the casing/frame 14, 13 cross-section. Rotation through 180° of the frame 13 whilst it is in the casing 14 is allowed due to the clearance or space 51 between the frame 13 and casing 14, the space 51 being typically and preferably between 3.2 mm and 20 mm.

Figure 6:
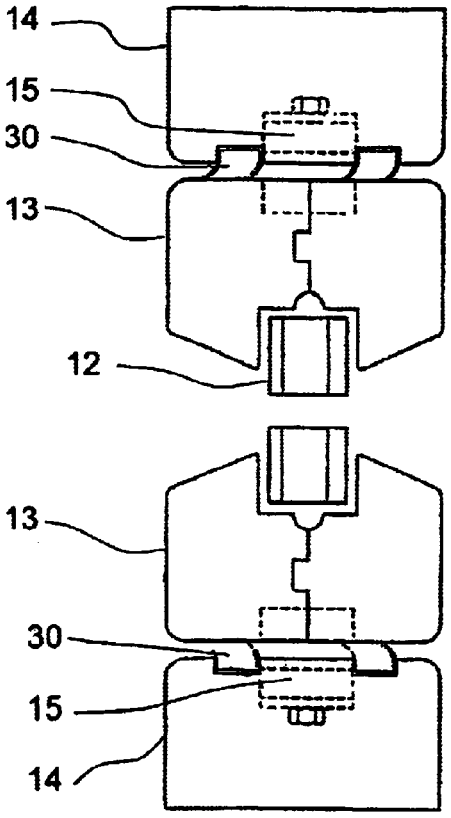
FIG. 6 is a cross-sectional views according to FIG. 1 illustrating U-shaped strips attached to the casing.
Figure 7:
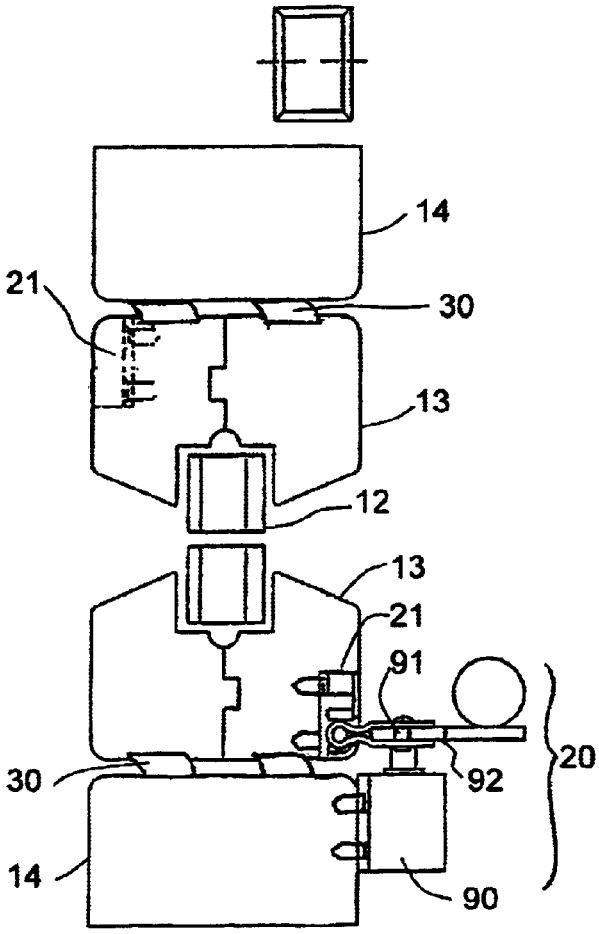
FIG. 7 is a cross-sectional views according to FIG. 1 illustrating U-shaped strips attached to the window frame and illustrating one embodiment of an opening and closing device.

As mentioned above, the air tightness takes place preferably by providing the U-shaped sections 30, secured to the frame 13 or to the casing 14 and of a dimension such that the U-shaped sections 30 are in constant contact with the adjacent frame 13 or casing 14. As shown in FIGS. 4, 6 and 7, the U-shaped sections 30 are sufficiently deformable so as to allow sizing slightly larger than the space 51 to ensure adequate sealing therebetween.

Optionally, and typically applied where the frame 13 supports a window 11, decorative fittings 53 are attached to the weather exposed face of the window 11 to improve the appearance of the window by covering up the space 51 between the frame 13 and the casing 14. The fittings 53 are removable, at least in part, to permit the frame 13 to be rotated 180°.

In principle it is irrelevant which portions of the concealed hinge 15 are fastened to the frame 13 and which are fastened to the casing 14, although owing to the thickness of material used to manufacture some embodiments of the hinge 15 it is generally preferable that the larger and more bulky portions which support the pivot 16, are attached or embedded in the casing 14, as will be described in greater detail below.

As shown in FIG. 1, the casing 14 is grooved or recessed to accommodate the bulkier portions of the hinge 15.

Figure 8C:
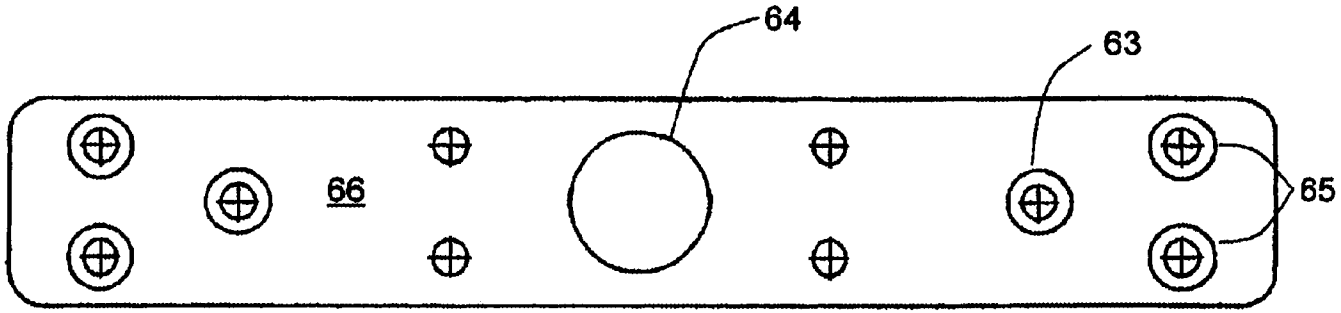
FIGS. 8*a–c* illustrate one embodiment of a concealed hinge, more particularly
Figure 8B:
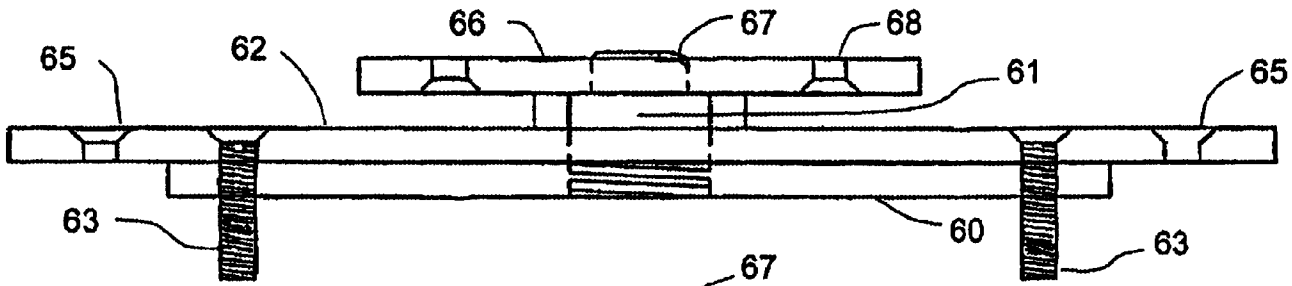
Figure 8A:
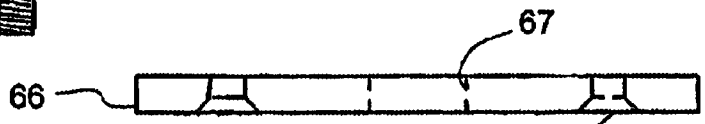
Figure 8A:
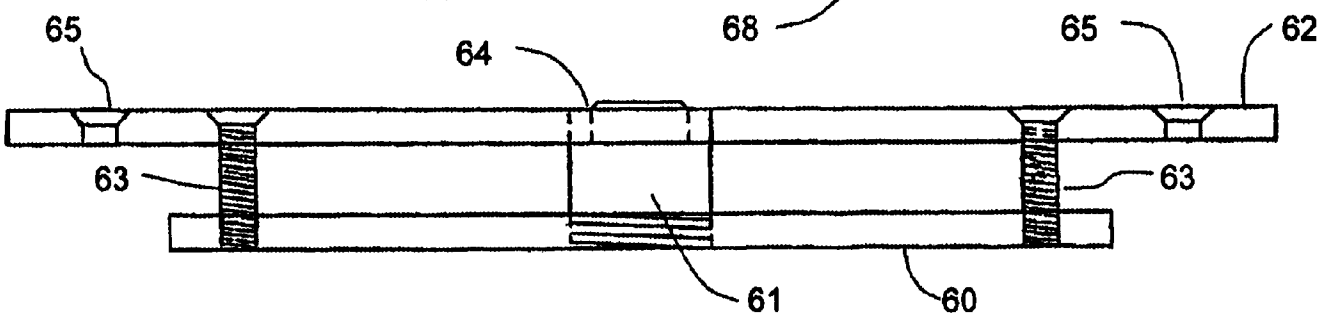

Having reference to FIGS. 8*a*–8*c*, one embodiment of a concealed hinge 15 is illustrated. A bolt plate 60 supporting a pivot bolt 61 is connected to a first mounting plate 62 via adjusting screws 63. The first mounting plate 62 has a hole 64 through which the pivot bolt 61 extends. The first mounting plate 62 is fastened to the frame 13 or preferably to the casing 14 by means such as screws (not shown), through holes 65. The hinge 15 is positioned so that the axis of rotation runs through the longitudinal axis of the pivot bolt 61.

A second mounting plate 66 is secured to the opposing of either the frame 13 or the casing 14 and preferably to the frame 13, The second mounting plate has a socket 67 for receiving the pivot bolt 61 extending through the first mounting plate 62. Holes 68 are provided in the second mounting plate 66 for securing it to the frame 13 using screws (not shown).

Once the pivot bolt plate and first mounting plate are mounted into the groove in the casing 14, the adjustment screws 63 are adjusted to extend or retract the pivot bolt 61 along the axis. For securing the frame 13 for pivoting within the casing 14, the pivot bolt is adjusted to extend sufficiently to engage the socket 67 in the second mounting plate on the frame 13. In order to effect this adjustment, the window is positioned into the casing, rotated roughly 90° to the casing. The adjustment screws 63 are positioned sufficiently far apart so that they can be accessed with the window in the 90° position. Actuation of the adjustment screws 63 causes the bolt plate 60 to move towards the first mounting plate 62, extending the attached pivot bolt 61 further through the hole 64. and into engagement with the socket 67 in the second mounting plate 66. Alternately, the pivot bolt 61 can be retracted from the socket 67 to release the frame 13 from the casing 14, should it be necessary to completely remove the frame 13, such as for repair or replacement.

The axis of rotation runs along the longitudinal axis of the pivot bolt 61, in addition to running in a plane approximately in the centre of the depth of the casing 14, also, in projection, divides the casing opening into two identical, upper and lower or left and right geometric parts, as the case may be, so as to allow an approximately symmetrical rotation.

More preferably, as shown in FIGS. 9*a*–*f*, 10*a*–*d*, 11*a*–*c* and 12*a*–*c* the frame 13 is restricted from free rotation, when in the open position, by a friction element 40 acting in each concealed hinge 15 to increase the friction in the hinge 15. Adjustment of the friction in the hinge 15 acts to counteract rotation caused by undesirable impacts, gusts of wind and the like. Additional friction added to the concealed hinge 15 and pivot bolt 61 acts to resist pivoting of the window about the pivot bolt 61.

A first embodiment for adjustment of the friction is simply to actuate the adjustment screws 63 and extend the pivot bolt 61 fully into the socket 67, imposing sufficient friction therebetween so as to cause the frame 13 to maintain an open position. The pivot bolt 61 may be stepped so as to form a shoulder which cannot pass through the socket 67.

As shown in FIGS. 9*a*–9*f*, a second embodiment of friction adjustment is shown, using a friction adjusting means 40. The pivot bolt plate 60 is secured to the first mounting plate 62 via adjusting screws 63. The pivot bolt 61 runs through the hole 64 in the first mounting plate 62 and extends into the socket 67 thereabove in the second mounting plate 66. A housing 41 is arranged between the pivot bolt 61 and the pivot bolt plate 60. The housing 41 is formed having a longitudinal groove 42 through which the bolt plate 60 passes. A plurality of friction discs 42, connected to a disc spring 43, are supported in the housing 41 below the pivot bolt 61. When the pivot bolt plate 60 is drawn towards the first mounting plate 62 by means of the screws 63, the friction discs 42 are pressed towards one another by the disc spring 43, creating sufficient friction to resist rotation of the window and the pivot bolt 61 within the housing 41.

Figure 9A:
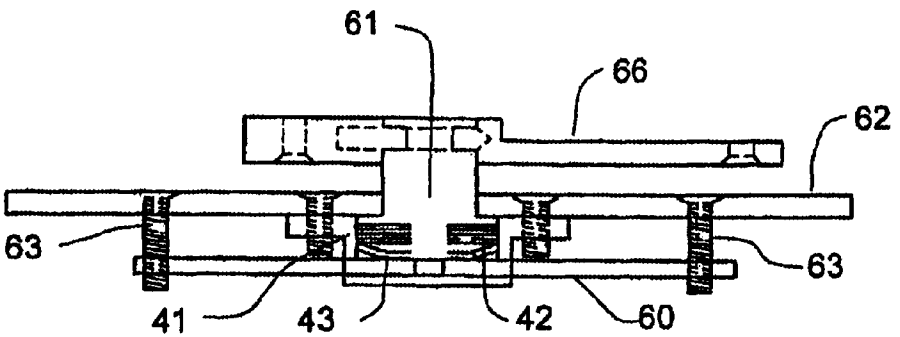
FIGS. 9*a* to 9*f* illustrate a second embodiment of a concealed hinge further comprising friction elements; more particularly.
Figure 9B:
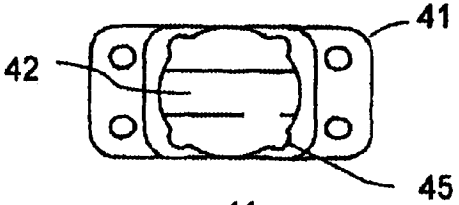
Figure 9C:
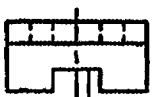
Figure 9E:
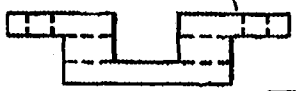
Figure 9D:
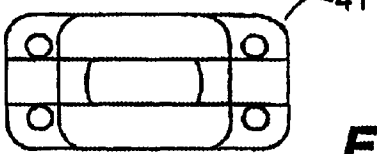
Figure 9F:
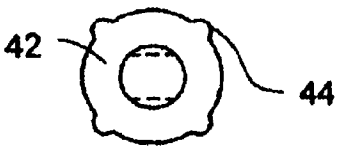

As shown in FIG. 9*f*, one embodiment of a friction disc 42, has protrusions 44 extending from the disc 42 that are held in the housing 41 and which are prevented from rotating with the pivot bolt 61 by means of corresponding recesses 45 in the housing 41.

Figure 9G:
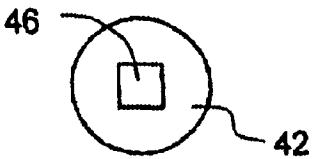
FIG. 9*g* is a plan view of a second embodiment of a friction disc.

As shown in FIG. 9*g*, a second embodiment of a friction disc 42 is held in place by means of a rectangular hole 46 in the friction disc 42 which engages a rectangular protrusion in the bottom of the housing 41.

As previously stated, using the embodiments of the friction elements shown in FIGS. 8*a*–*c* and 9*a*–*g*, the spacing between the adjustment screws 63 is slightly greater than the width of the frame 13 so that the adjustment screws 63 can be manipulated when the window 11 is positioned at 90° to the casing 14. It may be desirable, however, to have a friction element 40 that can be adjusted more simply.

Having reference to FIGS. 10*a*–*d*, a third embodiment of a friction element 40 is shown which embodies a simple adjustment mechanism for adjusting the friction between the pivot bolt 61 and the hinge 15. The pivot bolt 61 is formed as a double screw 70 with an upper threaded portion 71 having a relatively large diameter and a lower threaded portion 72 having a relatively small diameter and a square-cylindrical portion 73 arranged therebetween. A head 74 of the pivot bolt 61 engages the socket 67 in the second mounting plate 66. An adjusting nut 75 is screwed onto the pivot bolt 61, and more specifically onto the threaded portion 72. A disc spring 76 is arranged under the adjusting nut 75 and a plurality of friction discs 42 as described in the second embodiment. The friction element 40 is locked together as a single unit by a locking nut 77 which is screwed onto the lower threaded portion 72. When the pivot bolt 61 with friction element 40 is connected to the first mounting plate 62, a portion of the adjusting nut 75 will be visible between the casing 14 and the frame 13 and can be grasped with a suitable tool for adjusting the tension.

Figure 11A:
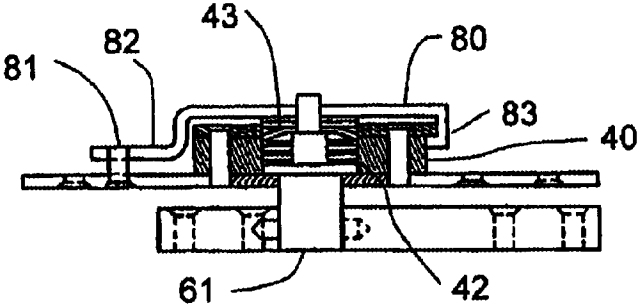
FIGS. 11*a* to 11*c* illustrate another alternate embodiment of a concealed hinge having a pivot bolt and friction elements, more particularly.
Figure 11B:
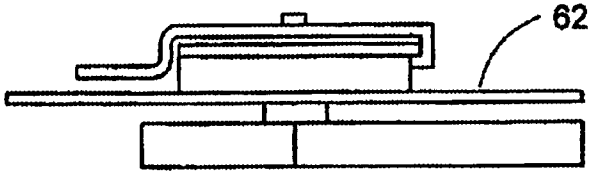
Figure 11C:
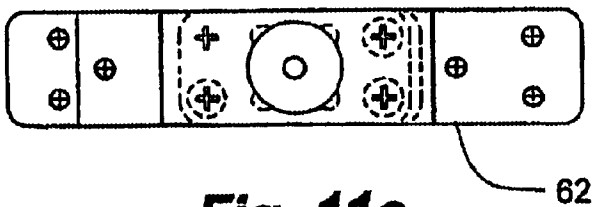

Having reference to FIGS. 11*a*–*c*, a fourth embodiment of a friction element 40 is shown. A lever arm 80, through which the top of the pivot bolt 61 extends is connected to the friction element 40 such that when an adjustment is made to an adjustment screw 81 at a first end 82, the lever arm 80 is caused to pivot about a second end 83 which applies or releases friction through compression or release of the disc spring 43 on the friction elements 42 about the pivot bolt 61.

Figure 12A:
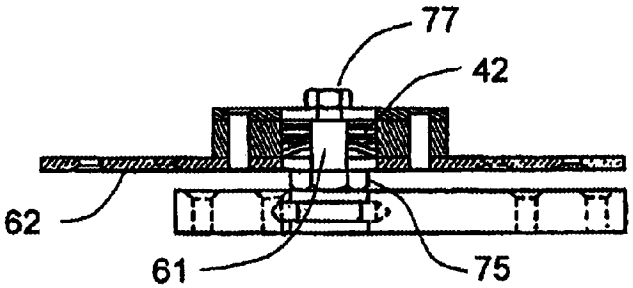
FIGS. 12*a* to 12*c* illustrate yet another alternate embodiment of a concealed hinge having a pivot bolt and friction elements, more particularly.
Figure 12B:
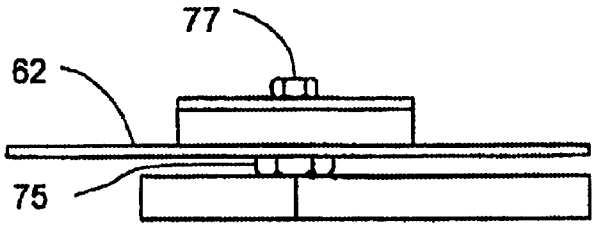
Figure 12C:
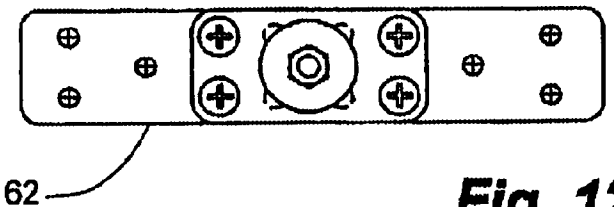

Having reference to FIGS. 12*a–c*, a fifth embodiment of a friction element 40 is shown, comprising the elements of the third embodiment, however arranged slightly differently. The arm 80 of the fourth embodiment is replaced by a retaining nut 77 attached to one end of the pivot bolt 61 on one side of the friction element 40. An adjustment nut 75 is attached to a second end 72 of the pivot bolt 61 on the other side of the friction element 40. Adjustment of nut 75 causes an alternation in the friction applied between the pivot bolt 61 and the hinge 15.

The embodiments, which are shown in FIGS. 11*a*–11*c* and FIGS. 12*a*–12*c*, are distinguished by a simple assembly, the hinge 15 incorporating these embodiments is less bulky than those previously disclosed herein and can easily be assembled in milled-out grooves (not shown) between the U-shaped strips 30.

The opening and closing device 20 is connected between the frame 13 and the casing 14 to both lock the window 11 into a closed position and to actuate the window 11 to pivot about the hinge 15.

Having reference to FIGS. 2, 3, 7 and 13*a–h*, one embodiment of an opening and closing device 20 is shown although others are known. The opening and closing device 20 comprises a block 90 which supports a guide pin 91 connected to an actuation arm 92 having a sliding track 93 with indexing stops for positioning. The block 90 is screwed into the casing 14 adjacent the connector 21*a*,21*b* (collectively 21) on the frame 13. A first end 94 of the actuation arm 92 is pivotally connected a bracket 95, which is removably connected to the connector 21*a*,21*b*. The guide pin 91 protrudes into the sliding track 93 in the actuation arm 92 to permit opening and locking the window 11 to a number or preset positions.

Shown in greater detail in FIGS. 7*g–h*, a slide rod 96 is mounted to the connector 21*a*,21*b* on the frame 13 and is secured thereon by a locking plate 97 which is readily removed to permit the window to be pivoted 180°. The bracket 95 has a tubular channel 98 through which the slide rod 96 is installed, prior to securing the slide rod 96 into the connector 21.

The sliding track 93 is formed having a plurality of slightly enlarged indexing areas 99 and a larger release opening 100, through which the guide pin 91 is inserted.

Figures 13A, 13B, 13C:
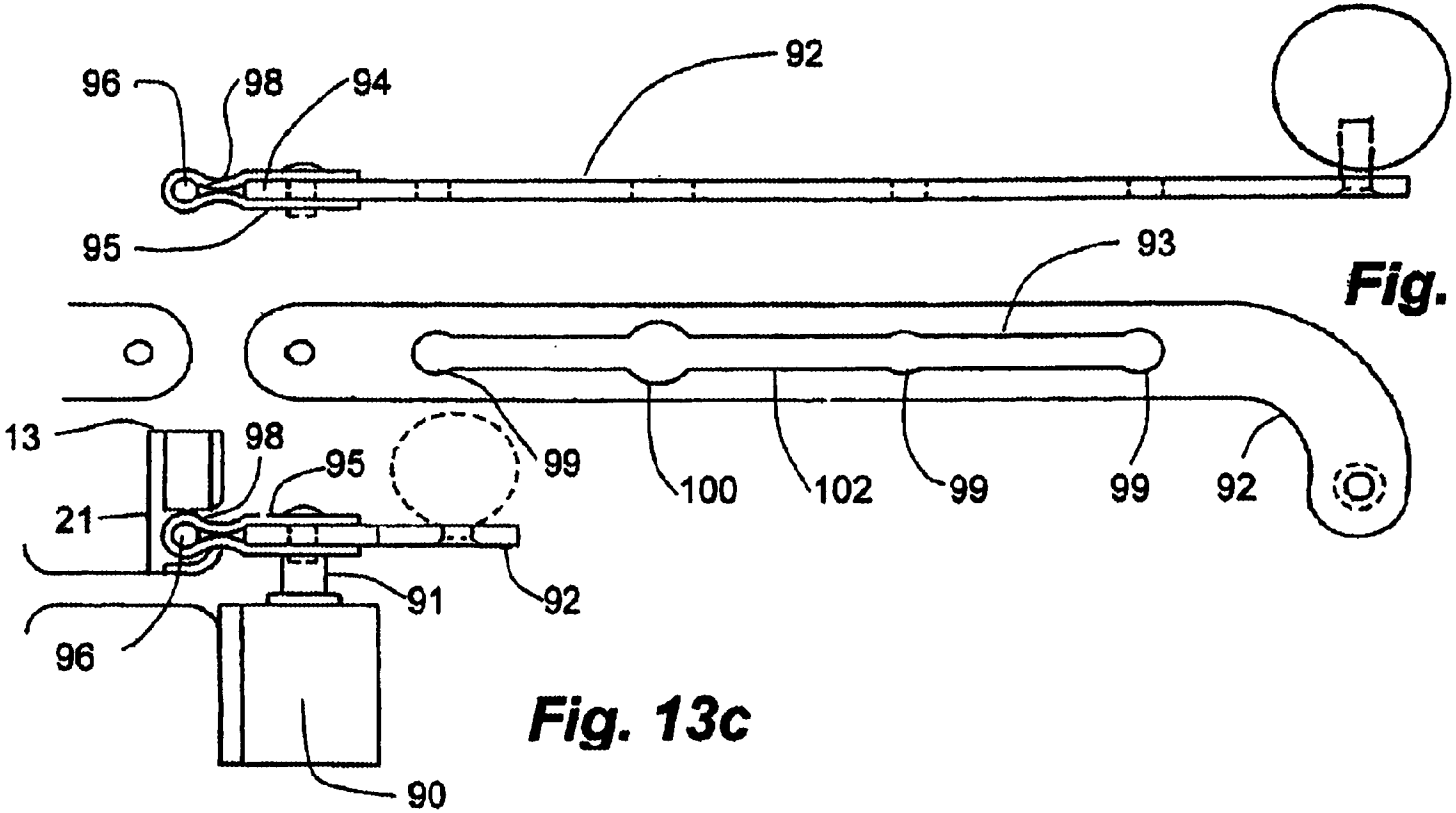
Figure 13D:
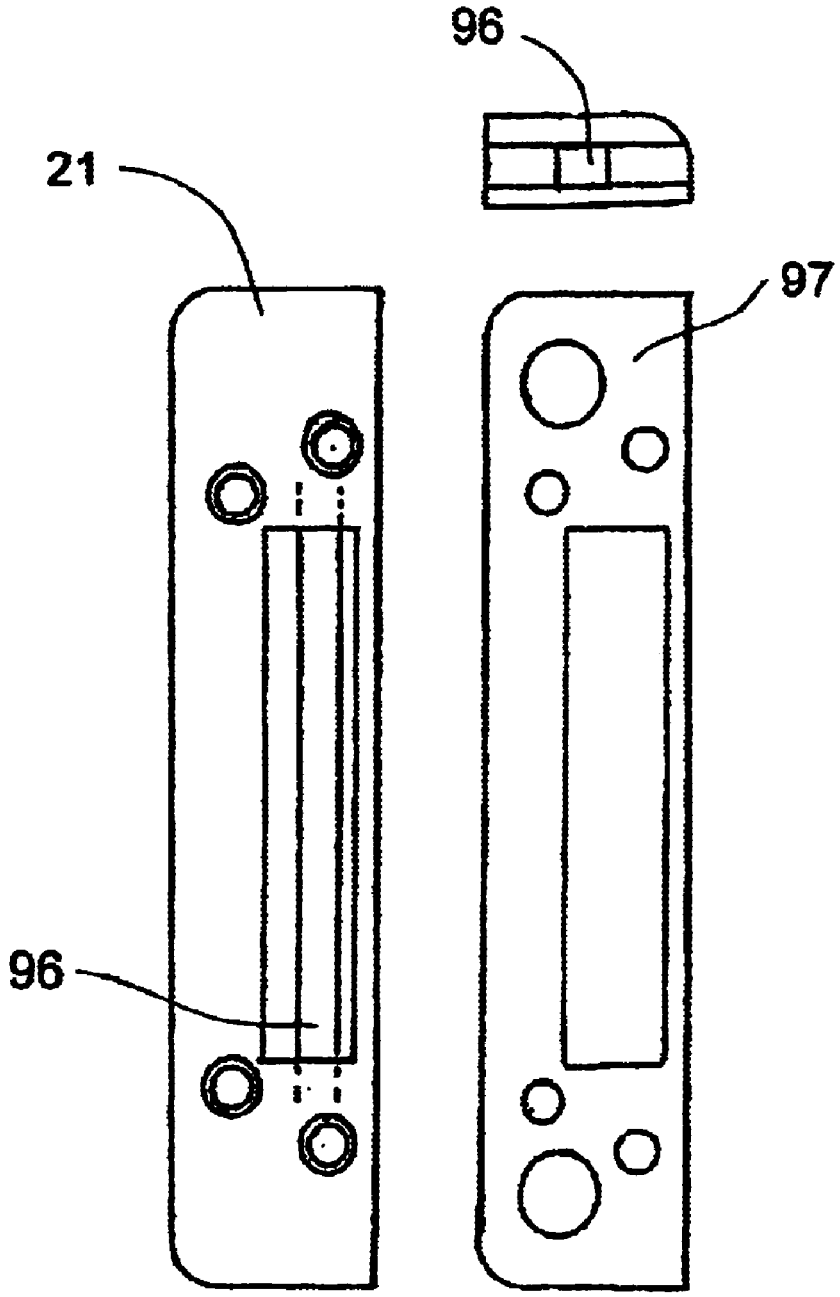

Preferably, as shown in FIGS. 13*d–e*, the guide pin 91 is slightly stepped in profile, having a collar area 101, which has the smallest diameter corresponding to the non-enlarged areas 102 of the sliding track 93 in the actuation arm 92. A lower and larger area 103 of the guide pin 91 corresponds to the diameter in the slightly enlarged track areas 99 which, when engaged in the slightly enlarged indexing areas 99, act to lock the window 11 in either a closed position or a chosen and variable open airing position, without any possibility of accessibility from the outside of the window 11.

The arm 92 is temporarily released from connection to the block 90 by removing the guide pin 91 through the release opening 100, which is larger than the largest diameter of the guide pin 91.

As shown in FIGS. 13*d–f*, further embodiments of the pin 91 are contemplated, allowing the pin 91 to be readily released from the sliding track 93. In one such embodiment, best seen in FIGS. 13*d* and *f*, the guide pin 91 is spring-loaded in the block 90. In a second embodiment best seen in FIG. 7*e*, the pin 91 is unscrewed from the block 90 in the form of an angle element 104.

By means of the inventive idea, it is for the first time possible to be able to utilize all the technical possibilities represented by different types of glazing in terms of light and heat reflection and transmission. This is achieved through enabling the turning of the window 11, or door or combinations thereof, parts of facades, partitions and the like, exactly 180° so that the whole unit remains in place and in sealing engagement with the surrounding casing 14, and by means of the outlined types of hardware which permit this,.

Because cladding panels, for example, are capable of being turned in a simple manner, these can be used both decoratively and commercially, with the possibility of, for instance, color variations, patterned facades and not least advertising, since all these features can be put in place with relative ease and further by turning the panel, can also be easily removed.

What is claimed is:

1. A system engaged with and pivotally supporting a frame having opposing faces, the frame being mounted on a casing, the system engaging either one face or an opposing face, the system comprising:

a pivot located between the casing and the frame at opposing positions along an axis which passes through the center of the frame for rotating the frame thereabout from 0–180 degrees;

deformable sealing elements positioned about a periphery of the frame and attached to one of either the casing or the frame for sealing between the casing and the frame;

connectors located on opposing faces of the frame and on opposing sides of the pivot to permit the frame to be alternately connected to the casing by the one face of the frame or by the opposing face of the frame; and an opening and closing device, alternately connectable between the casing and the connector on the one face and the connector on the opposing face of the frame so that, when connected, the opening and closing device can be actuated to open and close the frame relative to the casing, and when not connected, the frame can be rotated about the pivot to permit pivoting 180°.

2. The system as described in claim 1 wherein the pivot is a pivot bolt held in a concealed hinge, the hinge further comprising:

a first mounting plate;

a second mounting plate having a socket;

a pivot bolt plate positioned adjacent the first mounting plate, the pivot bolt being connected to the pivot bolt plate and extending through a pivot hole in the first mounting plate, wherein the pivot bolt further extends to the second mounting plate for engaging the socket therein for pivotally connecting between the casing and the frame permitting the frame to rotate about the pivot bolt.

3. The system as described in claim 2 wherein the pivot bolt plate is adjustable relative to the first mounting plate for extending the pivot bolt therethrough so as to alternately release and engage the pivot bolt with the second mounting plate.

4. The system as described in claim 3 wherein the pivot bolt plate and first mounting plate are mounted in the casing and the second mounting plate is mounted in the frame.

5. The system as described in claim 2 wherein the pivot bolt plate and first mounting plate are mounted in the casing and the second mounting plate is mounted in the frame.

6. The system as described in claim 2 wherein the concealed hinge further comprises a friction element acting between the pivot bolt and the pivot bolt plate for altering the friction acting on the pivot bolt to resist free rotation of the frame about the pivot bolt.

7. The system as described in claim 2 wherein the pivot bolt is a double screw further comprising:

an adjusting nut threaded at a first end;

a locking nut threaded at a second end; and a friction element comprising a plurality of friction discs and a spring positioned therebetween, the adjusting nut being rotated to alter friction acting on the pivot bolt.

8. The system as described in claim 1 further comprising deformable sealing elements adjacent either side of the pivot.

9. The system as described in claim 8 wherein the deformable sealing elements are sized slightly larger than the space between the casing and the frame so as to cause the deformable sealing elements to deform and seal therebetween.

10. The system as described in claim 1 wherein the deformable sealing elements are sized slightly larger than the space between the casing and the frame so as to cause the deformable sealing elements to deform and seal therebetween.

11. The system as described in claim 1 wherein the concealed hinge further comprises a friction element acting on the pivot bolt for altering the friction to resist free rotation of the frame about the pivot bolt.

12. The system as described in claim 1 wherein the opening and closing device further comprises:

a block fixed to the casing adjacent the location of the connector, the block having a guide pin extending therefrom; and an arm removably connected to the connector on the frame and having a sliding track formed thereon for engaging the guide pin attached to the block so as to permit movement of the guide pin therein for positioning or locking the position of the frame.

13. The system as described in claim 12 wherein the sliding track is sized so as to retain the guide pin for movement therein and further comprises a plurality of enlarged track areas for positioning the pin to lock the frame at a variety of angles within the casing.

14. The system as described in claim 12 wherein the arm is connected to the connector using a bracket.

15. The system as described in claim 12 wherein the sliding track has a release opening for engaging and disengaging the guide pin therein.

16. The system as described in claim 1 wherein the connector further comprising:

a fixed mounting plate attached to the frame adjacent the block;

a sliding rod; and a locking plate removably attached to the fixed mounting plate for sandwiching the sliding rod therebetween;

wherein the arm is removably attached to the sliding rod by the bracket for connection to the frame.

17. The system as described in claim 16 wherein the bracket has a tubular channel formed thereon through which the sliding rod is installed.

18. A system engaged with and pivotally supporting a frame having opposing faces, the frame being mounted on a casing, the system engaging either one face or an opposing face, the system comprising:

a pivot located between the casing and the frame at opposing positions along an axis which passes through the center of the frame for rotating the frame thereabout from 0–180 degrees;

deformable sealing elements positioned about a periphery of the frame and attached to one of either the casing or the frame for sealing between the casing and the frame; and connectors located on opposing faces of the frame and on opposing sides of the pivot to permit the frame to be alternately connected to the casing by the one face of the frame or by the opposing face of the frame;

wherein the pivot is a pivot bolt held in a concealed hinge, the hinge further comprising;

a first mounting plate;

a second mounting plate having a socket;

a pivot bolt plate positioned adjacent the first mounting plate, the pivot bolt being connected to the pivot bolt plate and extending through a pivot hole in the first mounting plate, wherein the pivot bolt further extends to the second mounting plate for engaging the socket therein for pivotally connecting between the casing and the frame permitting the frame to rotate about the pivot bolt, wherein the concealed hinge further comprises a friction element acting between the pivot bolt and the pivot bolt plate for altering the friction acting on the pivot bolt to resist free rotation of the frame about the pivot bolt and wherein the friction element comprises a plurality of discs positioned in a housing between the pivot bolt and the pivot bolt plate, the discs biased so as to urge the pivot bolt away from the pivot bolt plate.

19. The system as described in claim 18 wherein the friction discs are biased by a spring.

20. The system as described in claim 18, further comprising an opening and closing device, alternately connectable between the casing and a connector on the one face and the connector on the opposing face of the frame so that, when connected, the opening and closing device can be actuated to open and close the frame relative to the casing, and when not connected, the frame can be rotated about the pivot to permit pivoting 180°.

* * * * *